United States Patent [19]

Müller et al.

[11] 4,099,993

[45] Jul. 11, 1978

[54] PROCESS FOR PRODUCING AN EXTREMELY HARD MIXED CARBIDE LAYER ON FERROUS MATERIALS TO INCREASE THEIR RESISTANCE TO WEAR

[76] Inventors: Hermann Müller, Heinrich Hall Str. 2A, 7501 Marxzell; Otto Schaaber, Brauteichen 23, 282 Bremen 70, both of Fed. Rep. of Germany

[21] Appl. No.: 651,368

[22] Filed: Jan. 22, 1976

Related U.S. Application Data

[63] Continuation-in-part of Ser. No. 437,085, Jan. 28, 1974, abandoned.

[30] Foreign Application Priority Data

Jan. 26, 1973 [DE] Fed. Rep. of Germany ..... 2303756

[51] Int. Cl.[2] ..... C21D 1/74

[52] U.S. Cl. ..... 148/14; 148/27; 148/31.5

[58] Field of Search ..... 148/14, 31.5, 19, 27

[56] References Cited

U.S. PATENT DOCUMENTS

| | | | |
|---|---|---|---|
| 2,157,594 | 5/1939 | Cooper | 148/14 |
| 2,685,545 | 8/1954 | Sindeband | 148/31.5 |
| 2,921,877 | 1/1960 | Samuel et al. | 148/14 |

*Primary Examiner*—R. Dean

*Attorney, Agent, or Firm*—Sughrue, Rothwell, Mion, Zinn and Macpeak

[57] ABSTRACT

A process for producing an extremely hard, non-brittle, strongly-adhering mixed carbide layer consisting of vanadium and chromium on carboniferous ferrous materials by means of annealing to improve their specific properties such as wear resistance and corrosion resistance.

7 Claims, No Drawings

PROCESS FOR PRODUCING AN EXTREMELY HARD MIXED CARBIDE LAYER ON FERROUS MATERIALS TO INCREASE THEIR RESISTANCE TO WEAR

CROSS-REFERENCE TO RELATED APPLICATION

This Application is a Continuation-in-Part Application of Ser. No. 437,085 filed on Jan. 28, 1974, abandoned.

BACKGROUND OF THE INVENTION

1. Field of the Invention

The present invention relates to a process for producing an extremely hard, non-brittle, strongly-adhering mixed carbide layer on ferrous materials to improve their specific properties such as wear resistance and corrosion resistance.

2. Description of the Prior Art

Processes for producing wear-resistant surface layers on ferrous materials by means of thermo-chemical methods are already known. According to U.S. Pat. No. 2,685,545 (Sindeband), it has been proposed to coat ferrous materials having a carbon content of at least 0.4% with a metal carbide layer having a Vickers hardness of ca. 1500 to 1600. According to this known proposal, the carbide layers can also be in the form of a mixed carbide layer containing at least 2 metals from the group consisting of chromium, vanadium, titanium, columbium, tantalum, molybdenum and tungsten. The ferrous workpiece is packed in a casehardening powder containing at least two of the aforementioned metals. The piece then undergoes a heat treatment in the 500°-1700° C range. This is designed to produce a mixed carbide layer having a hardness of 1500 VH.

SUMMARY OF THE INVENTION

Proceeding from the above-mentioned state of the art, the present invention also relates to the production of a mixed carbide layer on carbon-containing ferrous materials. According to the object of the invention, the mixed carbide layers so produced should possess increased hardness, relatively low brittleness, should adhere well to the substrate and should also be corrosion-resistant and nonscaling.

The process according to the invention is characterized in that a vanadium, chromium and iron yielder is used wherein the proportion of vanadium to the proportion of chromium is so adjusted that when the ferrous material has a low carbon content, i.e., 0.45%, the chromium content is greater than the vanadium content, and the iron to vanadium content is in the ratio of 2:3 to 1:4.

The theory on which the invention is based is that the metal yielder consisting, for example, of a casehardening powder, must also contain iron in addition to the carbide-forming substances vanadium and chromium. The invention is also based on the theory that the quantities of vanadium and chromium must be adjusted according to the carbon content of the ferrous material. As a result, it is possible to provide workpieces which have a given carbon content lower than 0.4%, and even as low as 0.15%, with a continuous, durable and extremely hard mixed carbide layer which also possesses the advantage of increased corrosion- and scale-resistance.

The use of iron, as stipulated by the invention, together with vanadium results in that a mixed carbide layer is not produced outside of the workpiece. The iron prevents carbon, with which vanadium has a great affinity, from being drawn out of the workpiece, thereby avoiding formation of carbides outside of the workpiece on a decarbonized layer of the workpiece. The iron tends to result in the carbides being formed in the iron, thus providing the mixed carbide layers with a solid connection with the workpiece.

According to another aspect of the invention, the yielder consists of a casehardening powder in which iron and vanadium are present in the form of ferrovanadium. Ferrovanadium is a commercial product which is generally sold as a compound containing 80% or 60% vanadium. The remainder consists mainly of iron. Chromium is also present in this compound, preferably as pure chromium powder. The compound also contains an activator, for example, ammonium chloride and an inert residual substance or filler material — aluminum oxide.

When a casehardening powder of the afore-mentioned type is used, the workpieces are treated for a period of 2 to 4 hours at a annealing temperature of 950° - 1200° C. The layer thicknesses which are thereby obtained are variable, but on average about 30μm.

Another theory of the invention is that the total amount of carbide-forming metals which are available is regulated according to the particular carbon content. Accordingly the yielder material, i.e., the casehardening powder must be composed in such a way that during the annealing treatment this yielder only releases as many metals as can be used to form a carbide depending on the carbon content of surface layer to be treated of the ferrous workpiece. The metal yielder must be composed in such a way that, at the given reaction temperature, more vanadium and chromium is not "offered" than can be removed by the carbon to form mixed carbides. If, for example, an excessive amount of vanadium and chromium is given off by the metal yielder, an intermediate layer in the form of a carbon-free mixed crystal layer (solid solution layer) is formed between a thin outer mixed carbide layer consisting of vanadium and chromium carbide and the ferrous workpiece. This solid solution layer is undesirable as it possesses reduced hardness and other disadvantageous properties.

Provided hereafter is a Table indicating the results of a number of comparative tests. The tests were carried out for carbon contents of 0.15%, 0.25%, 0.45% and 0.60%. Hardness measurements were mainly carried out with a weight of 25 grams (micro-hardness). The comparative tests include examples falling both within and outside the teaching of the invention. The end column of the following table contains a description of the appearance of the layers produced.

| Example Number | Carbon Content | Composition of the Yielder | Duration of treatment and temperature | Vicker's Hardness | Nature of the Layer |
|---|---|---|---|---|---|
| 1 | 0.15% | 20% FeV; 60% Cr; 15% $Al_2O_3$; 5% $NH_4Cl$ | 4 h/1000° C | up to about 2600 HV | Continuous, closed mixed, carbide layer without underlying solid solution layer. |
| 2 | 0.15% | 30% FeV; 50% Cr; 15% $Al_2O_3$; | 4 h/1000° C | up to 2600 HV | Mixed carbide layer - not free of holes. Solid solution layer |

-continued

| Example Number | Carbon Content | Composition of the Yielder | Duration of treatment and temperature | Vicker's Hardness | Nature of the Layer |
|---|---|---|---|---|---|
| | | 5% $NH_4Cl$ | | | in some regions. |
| 3 | 0.15% | 40% FeV; 40% Cr; 15% $Al_2O_3$; 5% $NH_4Cl$ | 4 h/1000° C | could not be measured | Large holes in the outer mixed carbide layer. Solid solution later. |
| 4 | 0.25% | 20% FeV; 60% Cr; 15% $Al_2O_3$; 5% $NH_4Cl$ | 4 h/1000° C | up to 2300 HV | Continuous, hole-free mixed carbide layer. |
| 5 | 0.25% | 30% FeV; 50% Cr; 15% $Al_2O_3$; 5% $NH_4Cl$ | 4 h/1000° C | up to 2650 HV | Continuous, strong, hole-free mixed carbide layer. |
| 6 | 0.25% | 50% FeV; 30% Cr; 15% $Al_2O_3$; 5% $NH_4Cl$ | 4 h/1000° C | up to 2800 HV | Clearly visible holes in the mixed carbide layer. Solid solution layer. |
| 7 | 0.45% | 40% FeV; 40% Cr; 10% $Al_2O_3$; 10% $NH_4Cl$ | 3 h/1050° C | up to 2750 HV | Strong, continuous, hole-free mixed carbide layer. |
| 8 | 0.60% | 40% FeV; 40% Cr; 10% $Al_2O_3$; 10% $NH_4Cl$ | 3 h/10° C | up to 2750 HV | Continuous, hole-free mixed carbide layer. |
| 9 | 0.60% | 50% FeV; 30% Cr; 10% $Al_2O_3$; 10% $NH_4Cl$ | 3 h/1000° C | up to 3000 HV | Continuous, closed, hole-free mixed carbide layer. |

From the preceding test results it was possible to select the following optimum ferrovanadium (FeV) quantities in terms of the invention relative to the respective carbon content:

| Carbon Content | Quantity of FeV |
|---|---|
| 0.15 | 20% |
| 0.25% | 30% |
| 0.45% | 40% (1:1 in proportion to chromium) |
| 0.60% | 50% |

In the case of ferrous materials having a higher carbon content there is a greater margin for the proportion of vanadium or ferrovanadium. In this case it is always possible to reduce the chromium content at the expense of the hardness if a reduced hardness is permissible but a higher degree of corrosion and scale resistance is required.

What is claimed is:

1. A process for producing an extremely hard, nonbrittle adherent carbide layer on ferrous materials having a carbon content of less than 0.4% to improve wear and corrosion resistance, said process comprising annealing said ferrous material in the presence of a casehardening powder containing a vanadium yielder, a chromium yielder and an iron yielder wherein the iron to vanadium content of said case hardening powder is in the ratio of 2:3 to 1:4 and the chromium content of said powder is sufficiently greater than the vanadium content thereof to cause the formation of a continuous, hole free mixed carbide layer and wherein the total amount of vanadium and chromium present is sufficiently low to preclude the formation of a carbon-free mixed crystal layer between the ferrous material and the mixed carbide layer.

2. A process for producing an extremely hard, nonbrittle, adherent carbide layer on ferrous materials having a carbon content of less than 0.4% to improve wear resistance and corrosion resistance, said process comprising annealing said ferrous material at a temperature of 950°–1200° C for 2–4 hours in the presence of a case hardening powder containing ferrovanadium and chromium powder, wherein the iron to vanadium ratio in said case hardening powder is from 2:3 to 1:4 and the amount of said chromium powder is equal to or greater than said vanadium in the case hardening powder and wherein the total amount of vanadium and chromium present is sufficiently low to preclude the formation of a carbon-free mixed crystal layer between the ferrous material and the mixed carbide layer.

3. The process of claim 2 wherein said case hardening powder also contains ammonium chloride and aluminum oxide.

4. A process as claimed in claim 1, characterized in that the casehardening powder contains iron and vanadium in the form of ferrovandium.

5. A process as claimed in claim 4, characterized in that the casehardening powder includes pure chromium powder.

6. A process as claimed in claim 4, characterized in that the casehardening powder includes an activator of ammonium chloride and a filler material of aluminum oxide.

7. A process as claimed in claim 1, characterized in that the chromium yielder and vanadium yielder, when used during a treatment period of 2 – 4 hours at an annealing temperature of 950°–1200° C, only release as much chromium and vanadium as can be combined with the carbon of the ferrous workpiece to be treated, so as to form a vanadium carbide and a chromium carbide layer.

* * * * *